US008977181B2

(12) United States Patent
Shinohara

(10) Patent No.: US 8,977,181 B2
(45) Date of Patent: Mar. 10, 2015

(54) IMAGE FORMING APPARATUS

(71) Applicants: Kabushiki Kaisha Toshiba, Minato-ku, Tokyo (JP); Toshiba Tec Kabushiki Kaisha, Shinagawa-ku, Tokyo (JP)

(72) Inventor: Eiji Shinohara, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/076,599

(22) Filed: Nov. 11, 2013

(65) Prior Publication Data

US 2014/0193167 A1 Jul. 10, 2014

(30) Foreign Application Priority Data

Jan. 8, 2013 (JP) ..... 2013-001325

(51) Int. Cl.
*G03G 15/20* (2006.01)
*G03G 21/00* (2006.01)
*G03G 15/08* (2006.01)

(52) U.S. Cl.
CPC ..... *G03G 21/0094* (2013.01); *G03G 15/0844* (2013.01)
USPC ..... 399/341; 399/127; 399/257

(58) Field of Classification Search
CPC ..... G03G 15/0844
USPC ..... 399/127, 257, 341, 66, 71
See application file for complete search history.

(56) References Cited

U.S. PATENT DOCUMENTS

| | | | | |
|---|---|---|---|---|
| 7,630,656 | B2 * | 12/2009 | Endou et al. | 399/257 X |
| 7,844,191 | B2 * | 11/2010 | Endou et al. | 399/257 X |
| 8,280,265 | B2 * | 10/2012 | Haruyama | 399/257 X |
| 2009/0154970 | A1 * | 6/2009 | Yoshida et al. | 399/341 |
| 2011/0262197 | A1 * | 10/2011 | Imamiya et al. | 399/341 |
| 2011/0274445 | A1 | 11/2011 | Kabai | |

FOREIGN PATENT DOCUMENTS

| | | |
|---|---|---|
| JP | 05-289576 | 11/1993 |
| JP | 2010-249904 | 11/2010 |

OTHER PUBLICATIONS

Office Action of Notification of Reasons for Rejection for Japanese Patent Application No. 2013-001325 Dated Nov. 18, 2014, 8 pages.

* cited by examiner

*Primary Examiner* — Sandra Brase
(74) *Attorney, Agent, or Firm* — Amin, Turocy & Watson, LLP

(57) ABSTRACT

According to an embodiment, an image forming apparatus includes an image forming unit, an image erasing unit, and a control unit. The image forming unit performs an image forming process of forming an image on an image bearing body by a toner and transferring the toner image from the image bearing body onto a recording medium, and a refresh process of forming an image on the image bearing body by a toner and removing the toner image from the image bearing body. The control unit controls the image forming unit such that the image forming unit performs the refresh process together with the erasing process performed by the erasing unit.

10 Claims, 5 Drawing Sheets

IMAGE FORMING APPARATUS

CROSS-REFERENCE TO RELATED APPLICATION

This application is based upon and claims the benefit of priority from the prior Japanese Patent Application No. 2013-1325, filed on Jan. 8, 2013, the entire contents of which are incorporated herein by reference.

FIELD

Embodiments described herein relate generally to an image forming apparatus having a function of erasing an image formed on a recording medium.

BACKGROUND

An image forming apparatus such as a multi function peripheral (MFP) that forms an image on a recording medium, for example, a sheet is proposed. The image forming apparatus includes a development unit that develops an electrostatic latent image formed on a photoreceptor using a two-component developer formed of, for example, a toner and a carrier, as a color material. The development unit stirs the two-component developer to charge the toner. The development unit supplies the charged toner to the photoreceptor to develop the electrostatic latent image of the photoreceptor, thereby forming a toner image. The image forming apparatus transfers the toner image onto the sheet and further fixes the toner image, thereby forming an image on the sheet. Since the toner is consumed for each image forming process, a new toner is supplied to the development unit when an internal toner concentration is a predetermined value or less.

A remaining toner which is not used for each image forming process is accumulated in the development unit. The accumulated toner is stirred whenever an image is formed, and charging performance thereof gradually deteriorates. The deteriorated, toner causes deterioration of the formed image, such as attachment to a non-image area of the sheet. In the image forming apparatus, for example, when the image forming process of a low printing rate with low toner consumption is continued, the deteriorated toner is easily accumulated in the development unit, and a trouble such as deterioration of the formed image easily occurs.

Accordingly, in order to solve the problem of the deteriorated toner, the image forming apparatus periodically performs a toner refresh process between the image forming processes. The toner refresh process is a process of forcibly forming an image on a photoreceptor by the development unit to consume the deteriorated toner in the development unit.

In addition, an image forming apparatus which can perform an image forming process of forming an image on a sheet using a color-erasable toner, and an erasing process of erasing the image formed on the sheet using an erasable toner has been developed. Even in the image forming apparatus, in order to solve the accumulation of the deteriorated toner, it is conceivable to periodically Perform the refresh process between the image forming processes. However, during the period of performing the refresh process, another process cannot be performed, and thus it is preferable that the period of performing the refresh process be short as possible.

FIG, 3 is a flowchart illustrating the refresh process of the image forming apparatus according to the first embodiment.

Figure 4:
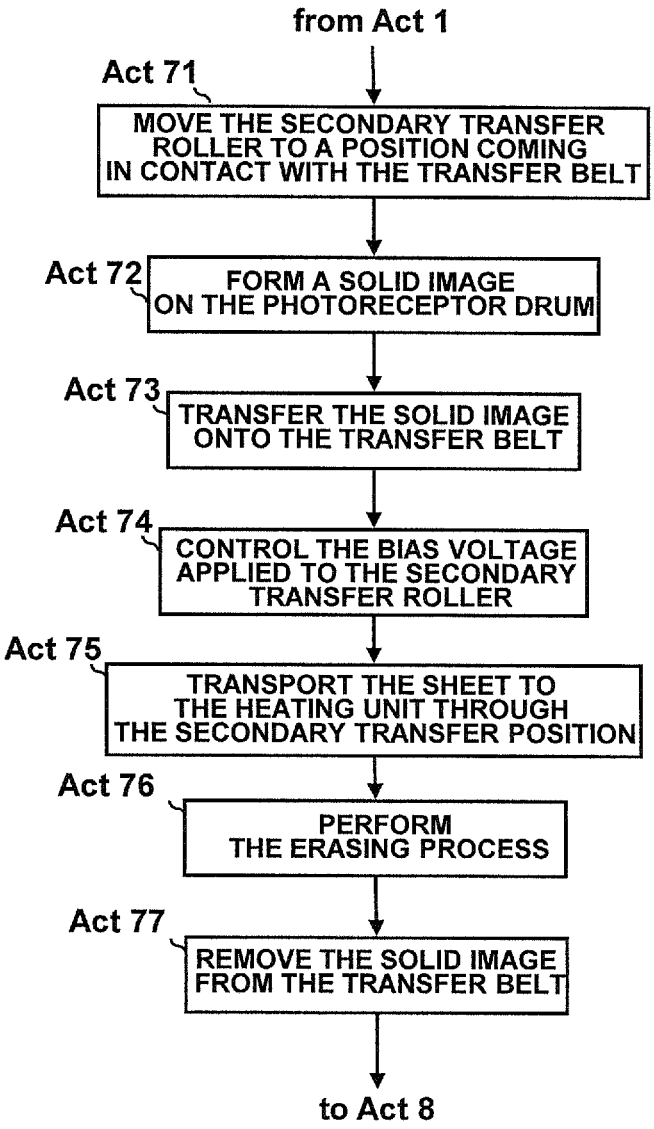

FIG. 4 is a flowchart illustrating an erasing process and the refresh process of the image forming apparatus according to the first embodiment.

Figure 5:
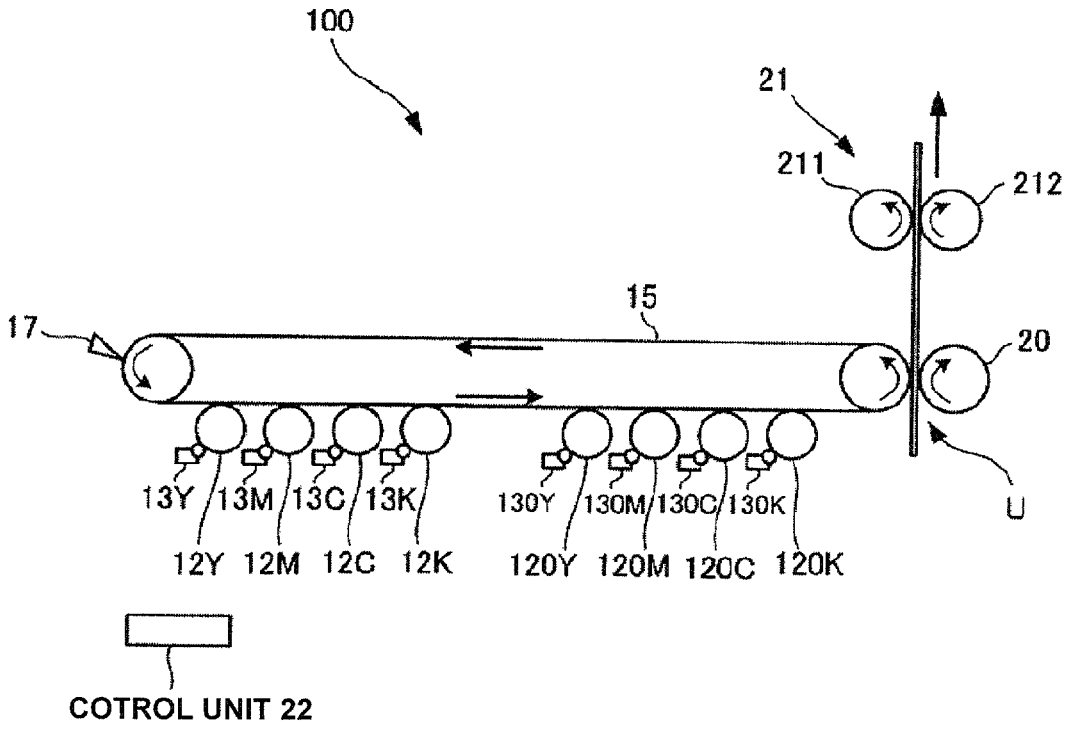

FIG. 5 is a cross-sectional view illustrating main units of an image forming apparatus according to a second embodiment.

DETAILED DESCRIPTION

According to an embodiment, an image forming apparatus which has an erasing function of erasing an image formed on a recording medium using an erasable toner is provided. The image forming apparatus includes an image forming unit, an erasing unit, and a control unit. The image forming unit performs an image forming process of forming an image on an image bearing body by a toner and transferring the toner image from the image bearing body onto a recording medium, and a refresh process of forming an image on the image bearing body by the toner and removing the toner image from the image bearing body. The erasing unit erases the image formed on the recording medium using an erasable toner. The control unit controls the image forming unit such that the image forming unit performs the refresh process together with the erasing process performed by the erasing unit.

Figure 1:
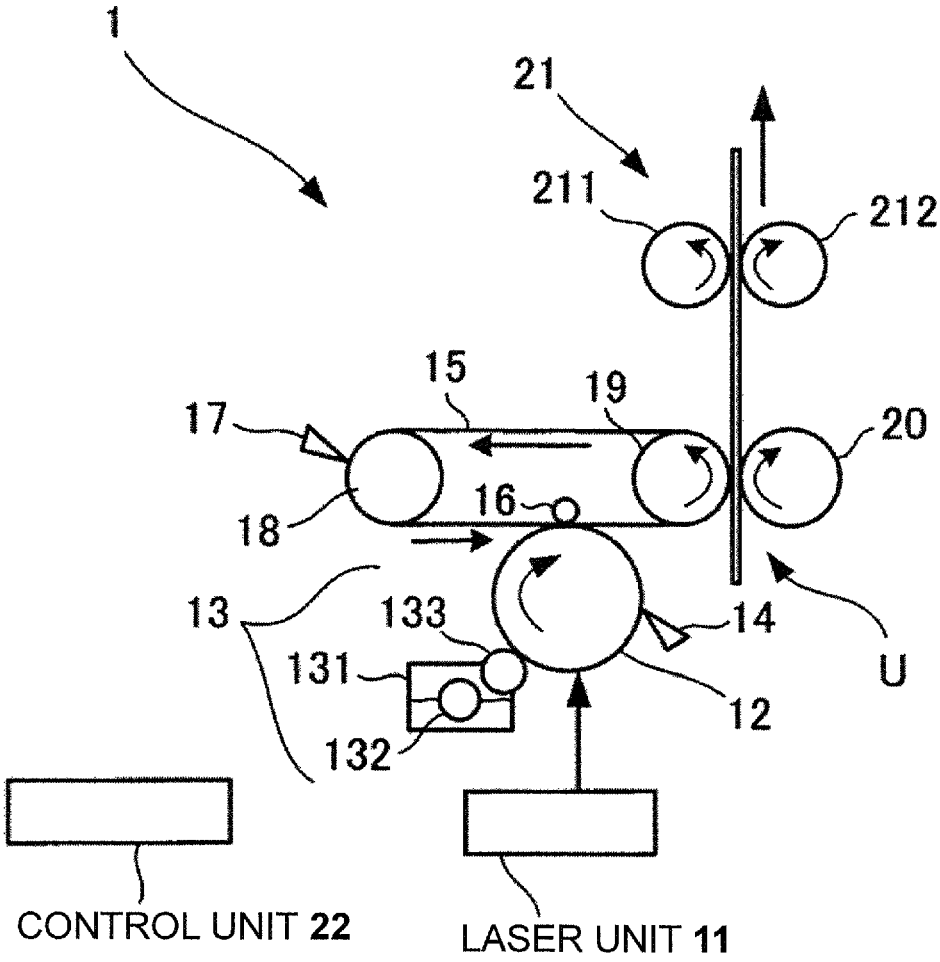
FIG. 1 is a cross-sectional view illustrating main units of an image forming apparatus according to a first embodiment.

Hereinafter, the embodiment will be further described with reference to the drawings. In the drawings, the same sign represents the same or similar portion. A first embodiment will be described with reference to FIG. 1. FIG. 1 is a cross-sectional view illustrating main units of an image forming apparatus 1 of the first embodiment. The image forming apparatus 1 can perform an image forming process of forming an image on a recording medium, for example, a sheet using a color-erasable toner, and an erasing process of erasing the image formed on the sheet using the erasable toner. The erasable toner is a toner, color of which is erased, for example, by heating. The image forming apparatus 1 may be configured as an MFP which can perform a scanner process, a FAX process or the like in addition to the processes described above. The image forming apparatus 1 includes an image forming unit. As illustrated in FIG. 1, the image forming unit includes a laser unit 11, a photoreceptor drum 12 and a transfer belt as an image bearing body, a development unit 13, cleaning blades 14 and 17, a driving roller 18, and a secondary transfer opposed roller 19. The image forming apparatus 1 includes a transfer unit. The transfer unit includes a primary transfer roller 16 and a secondary transfer roller 20. The image forming apparatus 1 includes an erasing unit. The erasing unit includes a heating unit 21 also serving as a fixing unit. The image forming apparatus 1 includes a control unit 22. The image forming apparatus 1 further includes first and second sheet feeding cassettes (not illustrated) that accommodate sheets.

The first cassette accommodates a sheet P1 on which an image is not formed. The second sheet feeding cassette accommodates a sheet P2 on which an image is formed by the erasable toner. The laser unit 11 performs exposure scanning on the photoreceptor drum 12 to form an electrostatic latent image on the photoreceptor drum 12. The photoreceptor drum 12 has a photosensitive surface, an outer peripheral surface of which is formed of an organic photo conductor (OPO) or the like. The photoreceptor drum 12 bears a toner image formed on the photosensitive surface by a development unit 13 to be described later, and rotates clockwise in FIG. 1.

The development unit 13 supplies the erasable toner to the photoreceptor drum 12 to develop the electrostatic latent image of the photoreceptor drum 12, thereby forming a toner image on the photoreceptor drum 12. The development unit 13 includes a development chamber 131, a stirring member 132, and a development roller 133. The development chamber 131 accommodates a two-component developer formed of an erasable toner and a carrier. The erasable toner includes, for example, a coloring compound, a developer, and a decolorant. The coloring compound may be, for example, a Leuco dye which develops color in blue. The developer may be, for example, phenols. The decolorant may be, for example, a substance that is compatible with the coloring compound by heating and has no affinity to the developer. The erasable toner is colored by interaction between the coloring compound and the developer, and is decolored by disconnection of the interaction between the coloring compound and the developer by heating at equal to or higher than an erasing temperature.

The stirring member 132 stirs the developer in the development chamber 131 to charge the erasable toner by friction, for example, to a negative polarity. The development roller 133 includes a magnet roller therein. The development roller 133 absorbs the toner by magnetic force of the magnet roller, and forms a magnetic brush bristled along magnetic field lines of the magnet roller on an outer peripheral surface. The development roller 133 allows the magnetic brush to be rubbed against the photoreceptor drum 12 while rotating, to supply the toner to the electrostatic latent image of the photoreceptor drum 12. The development unit 13 supplies the toner to the photoreceptor drum 12 to develop the electrostatic latent image, thereby forming an image using the toner on the photoreceptor drum 12.

The cleaning blade 14 is provided in a state of being pressed to the photoreceptor drum 12 by a constant pressure, by a biasing member such as a spring. The cleaning blade removes the toner which is not transferred onto the transfer belt 15 and remains on the photoreceptor drum 12, from the photoreceptor drum 12. The transfer belt 15 is supported in an endless-ring shape by the driving roller 18 and the secondary transfer opposed roller 19. The transfer belt 15 is driven by the driving roller 18, and rotates counterclockwise in FIG. 1. The transfer belt 15 bears the toner image transferred from the photoreceptor drum 12, and transfers the toner image onto the sheet P1 in cooperation with the secondary transfer roller 20.

The primary transfer roller 16 is formed of a metal roller having conductivity. The primary transfer roller 16 is opposed to the photoreceptor drum 12 with the transfer belt 15 interposed therebetween. For example, a positive transfer bias voltage is applied to the primary transfer roller 16. When the transfer bias voltage is applied to the primary transfer roller 16, a transfer electric field directed from the primary transfer roller 16 to the photoreceptor drum 12 is formed. The primary transfer roller 16 transfers the negatively charged toner image of the photoreceptor drum 12 to the transfer belt 15.

The cleaning blade 17 is provided in a state of being pressed to the transfer belt 15 at a constant pressure by a biasing member such as a spring. The cleaning blade 17 removes the toner which is riot transferred onto the sheet P1 and remains on the transfer belt 15, from the transfer belt 15. The driving roller 18 drives the transfer belt 15 to rotate. The secondary transfer opposed roller 19 is formed of a metal roller having conductivity. The secondary transfer opposed roller 19 interposes the sheet with the secondary transfer roller 20, with the transfer belt 15 interposed therebetween.

The secondary transfer roller 20 is formed of a metal roller having conductivity. The secondary transfer roller 20 is supported to be contactable and separable with respect to the transfer belt 15 by a contact and separation mechanism (not illustrated). The secondary transfer roller 20 is moved to a position coming in contact with the transfer belt 15 by the contact and separation mechanism when the image forming process is performed. The position where the secondary transfer roller 20 comes in contact with the transfer belt 15 is referred to as a secondary transfer position U. When the image forming process is performed, the sheet P1 is transported from the first cassette to the secondary transfer position U. A positive transfer bias is applied to the secondary transfer roller 20 when the sheet P1 is transported to the secondary transfer position U. When the positive transfer bias is applied to the secondary transfer roller 20, a transfer electric field directed from the secondary transfer roller 20 to the transfer belt 15 side (the secondary transfer opposed roller 19) is formed, and the negatively charged toner image of the transfer belt 15 is transferred onto the sheet P1.

The heating unit 21 includes a heating roller 211 and a pressure roller 212. The heating roller 211 has a heater therein, and is configured to control a heating temperature. The pressure roller 212 forms a nip portion with the heating roller 211. The heating unit 21 interposes the sheet in the nip portion such that heat conduction from the heating roller 211 to the sheet is fine.

When the image forming process is performed, the heating unit 21 serves as the fixing unit, and the heating temperature is controlled to be a fixing temperature. The heating unit 21 heats and presses the sheet P1 onto which the image formed by the erasable toner is transferred, at the fixing temperature, for example, 80° C., to dissolve the erasable toner of the sheet P1, and fixes the image formed by the erasable toner to the sheet P1. When the erasing process is performed, the heating unit 21 serves as the erasing unit, and the heating temperature is controlled to be an erasing temperature. The heating unit 21 heats and presses the sheet P2 at the erasing temperature higher than the fixing temperature, for example, 90° C., to erase the image formed by the erasable toner.

The control unit 22 controls the whole of the image forming apparatus 1. The control unit 22 includes a processor, an application specific integrated circuit (ASIC), a memory, and a hard disk drive (HOD). The processor executes a program stored in the memory or the HDD to realize various functions. The ASIC is a circuit only for realizing a specific function. The ASIC may play a role of a proper function which the processor realizes.

Figure 2:
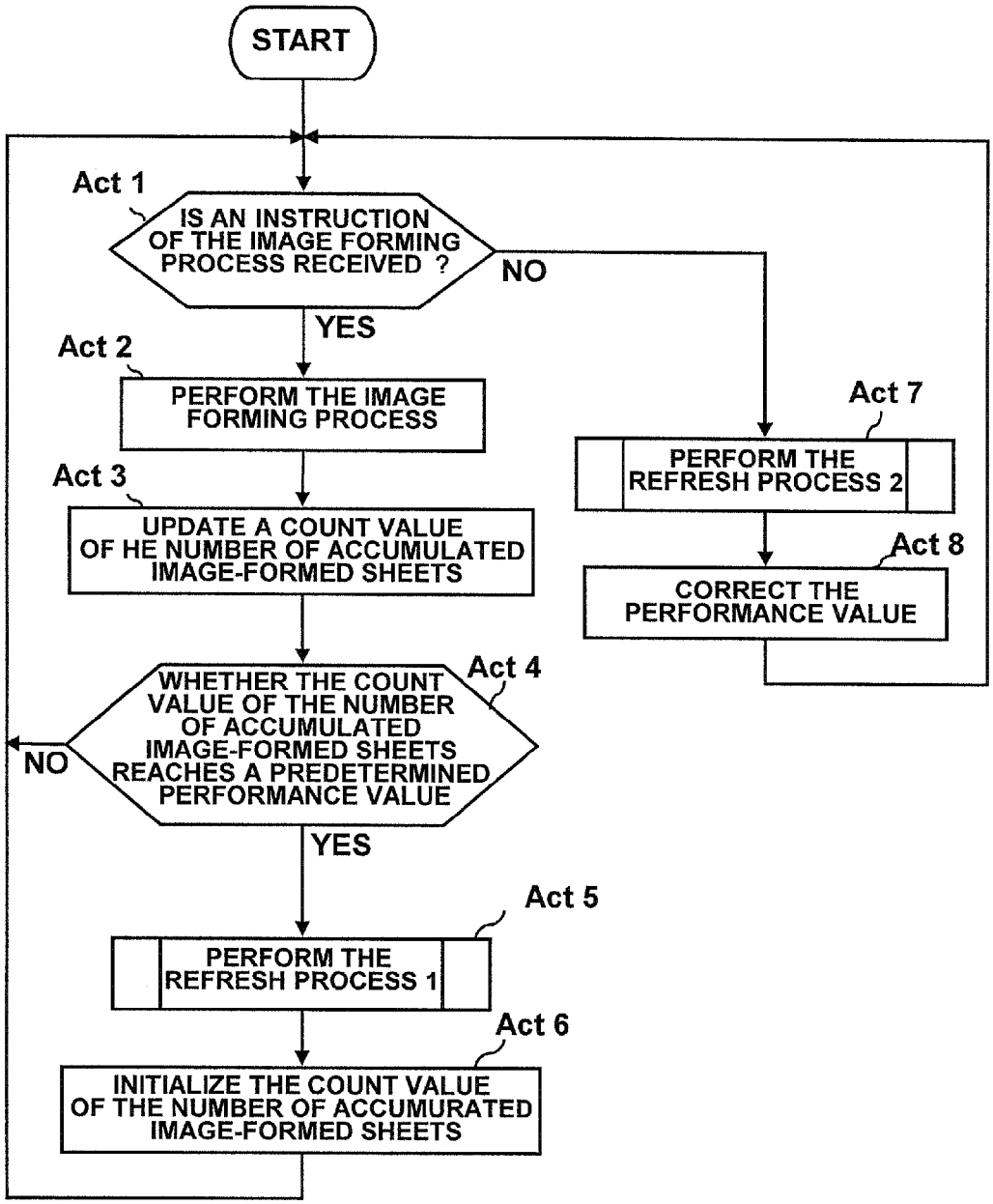
FIG. 2 is a flowchart illustrating an image forming process and a refresh process of the image forming apparatus according to the first embodiment.

The image forming process and a toner refresh process performed by the image forming apparatus 1 will be described with reference to FIG. 2. FIG. 2 is a flowchart illustrating the image forming process and the toner refresh process of the image forming apparatus 1. As illustrated in FIG. 2, in Act 1, the control unit 22 determines whether an instruction of the image forming process is received or an instruction of the erasing process is received from a user by an operation panel (not illustrated). When the control unit 22 determines that the instruction of the image forming process is received (Yes in Act 1), the operation of the image forming apparatus 1 proceeds to Act 2. In Act 2, the control unit 22 drives constituent elements related to the image forming process of the image forming apparatus 1. The image forming apparatus 1 takes the sheet P1 out of a first cassette (not illustrated), and forms an image on the sheet P1 by the erasable toner. Specifically, the control unit 22 rotates the photoreceptor drum 12, and controls the operations of the laser unit 11 and the development unit 13. The laser unit 11 forms an electrostatic latent image on the photoreceptor drum 12. The development unit 13 develops the electrostatic latent image to form an image on the photoreceptor drum 12 by, for example, a negatively charged erasable toner. In addition, the control unit 22 rotates the transfer belt 15, and applies a positive transfer bias voltage to the primary transfer roller 16. The primary transfer roller 16 transfers the image formed by the erasable toner from the photoreceptor drum 12 to the transfer belt 15. In addition, the control unit 22 moves the secondary transfer roller 20 to a position coming in contact with the transfer belt 15.

After the image formed by the erasable toner is transferred onto the transfer belt 15, the control unit 22 controls a transport unit (not illustrated) to transport the sheet P1 to the secondary transfer position U. The control unit 22 applies a positive transfer bias voltage to the secondary transfer roller 20 to form a transfer electric field directed from the secondary transfer roller 20 to the transfer belt 15 side (the secondary transfer opposed roller 19). The secondary transfer roller 20 transfers the image formed by the negative erasable toner of the transfer belt 15, onto the sheet P1 by the transfer electric filed. The control unit 22 controls the heating temperature of the heating unit 21 at the fixing temperature, for example, 80° C. The heating unit 21 heats and presses the sheet P1 to fix the image formed by the erasable toner to the sheet P1.

After the image forming process, in Act 3, the control unit 22 updates a count value of the number of accumulated image-formed sheets P1 from an initial state by increasing by "1" as the number of image formation times. The image forming apparatus 1 performs the toner refresh process periodically, for example, whenever images are formed on 500 sheets P1. Specifically, in Act 4, the control unit 22 determines whether the count value of the number of accumulated image-formed sheets reaches a predetermined performance value, for example, 500 sheets. When the control unit 22 determines that the count value of the number of accumulated image-formed sheets does not reach the predetermined performance value (NO in Act 4), the operation of the image forming apparatus 1 returns to Act 1. When the control unit 22 determines that the count value of the number of accumulated image-formed sheets reaches the predetermined performance value (YES in Act 4), the operation of the image forming apparatus 1 proceeds to Act 5. In Act 5, the image forming apparatus performs the toner refresh process. Hereinafter, the periodically performed toner refresh process may be merely referred to as a refresh process 1.

Figure 3:
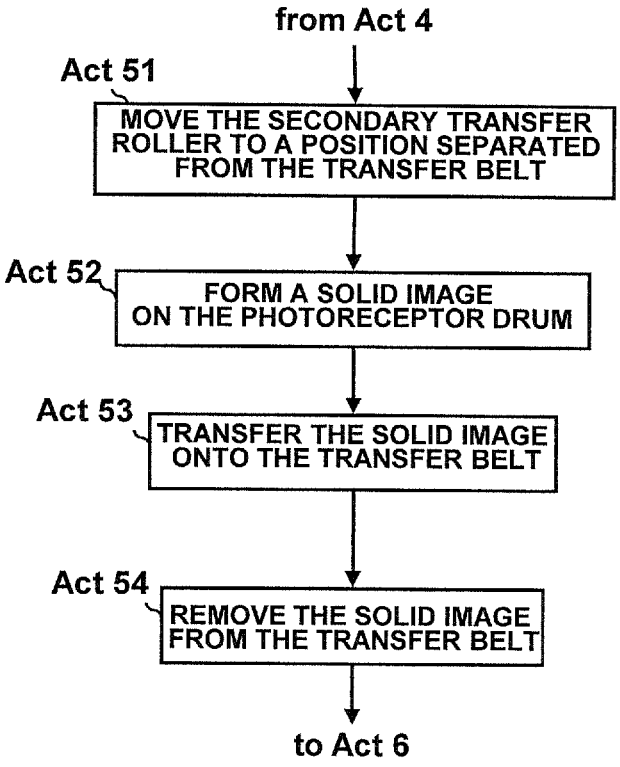

The refresh process 1 will be described with reference to FIG. 3. FIG. 3 is a flowchart illustrating the refresh process 1 of the image forming apparatus 1. As illustrated in FIG. 3, in Act 51, the control unit 22 moves the secondary transfer roller 20 to a position separated from the transfer belt 15 by a contact and separation mechanism not illustrated). In Act 52, the control unit 22 rotates the photoreceptor drum 12 and the transfer belt 15 to operate the development unit 13 for the refresh process 1. The development unit 13 forms an image formed by the toner, for example, a solid image in which an A4-size area is filled by the erasable toner, on the photoreceptor drum 12. In Act 53, the control unit 22 applies a transfer bias to the primary transfer roller 16. The primary transfer roller 16 transfers the solid image from the photoreceptor drum 12 onto the transfer belt 15. In Act 54, the transfer belt 15 rotates to transport the solid image to a position of the cleaning blade 17. The cleaning blade 17 removes the solid image from the transfer belt 15. The image forming apparatus 1 forms the solid image as described above to discharge the deteriorated erasable toner from the inside of the development unit 13, thereby forcibly consuming the erasable toner.

In the refresh process 1, since the secondary transfer roller 20 is moved to the position separated from the transfer belt 15, the solid image is prevented from being attached from the transfer belt 15 to the secondary transfer roller 20. In Act 52 to Act 54, the control unit 22 continuously forms the solid images with the number to sufficiently consume the deteriorated toner of the development unit 13, and further removes the solid image from the upper face of the transfer belt 15, thereby performing the refresh process 1.

After performing the refresh process 1, the operation of the image forming apparatus 1 proceeds to Act 6. In Act 6, the control unit 22 initializes the count value of the number of accumulated image-formed sheets to 0. After initializing the count value, the operation of the image forming apparatus 1 returns to Act 1. Meanwhile, in Act 1, when the control unit 22 determines that the instruction of the erasing process from the user is received (NO in Act 1), the operation of the image forming apparatus 1 proceeds to Act 7. In Act 7, the image forming apparatus 1 performs the toner refresh process with the erasing process. Hereinafter, the toner refresh process performed with the erasing process may be merely referred to as a refresh process 2.

The decoloring process and the refresh process 2 will be described with reference to FIG. 4. FIG. 4 is a flowchart illustrating the erasing process and the refresh process 2 of the image forming apparatus 1. As illustrated in FIG. 4, in Act 71, the control unit 22 moves the secondary transfer roller 20 to a position coming in contact with the transfer belt 15 by the contact and separation mechanism, to transport the sheet P2 to the heating unit 21. In Act 72, the control unit 22 rotates the photoreceptor drum 12 and the transfer belt 15 to operate the development unit 13 for the refresh process 2. Similarly to Act 52, the development unit 13 forms an A4-size solid image formed by the erasable toner, on the photoreceptor drum 12. In Act 73, the control unit 22 applies a transfer bias to the primary transfer roller 16. Similarly to Act 53, the primary transfer roller 16 transfers the solid image from the photoreceptor drum 12 to the transfer belt 15.

In Act 74, the control unit 22 controls the bias voltage applied to the secondary transfer roller so as not to transfer the solid image to the sheet P2. For example, the control unit 22 controls the bias voltage such that the bias voltage is the negative bias voltage with the polarity reverse to the polarity at the time of transferring. By applying the negative bias voltage to the secondary transfer roller 20, a non-transfer electric field directed from the transfer belt 15 side (the secondary transfer opposed roller 19) to the secondary transfer roller 20 is formed. Instead of the negative bias voltage, the bias voltage may not be applied to the secondary transfer roller. In Act 75, the control unit 22 controls a sheet transport unit (not illustrated) to take the sheet P2 out of the second cassette and to cause the sheet P2 to pass through the secondary transfer position U. When the sheet P2 passes through the secondary transfer position U, the secondary transfer roller 20 suppresses that the negative solid image of the transfer belt 15 is transferred onto the sheet P2 by the non-transfer electric field directed from the transfer belt 15 side to the secondary transfer roller 20. Even when the solid image comes in contact with the sheet P2 at the secondary transfer position U, the solid image is not transferred onto the sheet P2 and remains on the transfer belt 15.

In Act 76, the control unit 22 controls the heating temperature of the heating unit 21 to the erasing temperature, for example, 90° C. The sheet P2 passes through the secondary transfer position U, and is transported to the heating unit 21. The heating unit 21 heats and presses the sheet P2 to erase the image formed on the sheet P2 by the erasable toner. Even when the whole or a part of the solid image is transferred from the transfer belt 15 onto the sheet P2 as the sheet P2 passes through the secondary transfer position U, the solid image is formed by the erasable toner and thus the heating unit 21 erases the solid image.

In Act 77, the transfer belt 15 rotates to transport the solid image to the position of the cleaning blade 17. The cleaning blade 17 removes the solid image from the transfer belt 15. As described from Act 71 to Act 77, the control unit 22 controls the refresh process 2 to form, for example, the solid image once during the decoloring process of one sheet, to remove the solid image. When the decoloring process of a plurality of sheets is continuously performed, a larger number of solid images than the number of sheets P2 to be erase-processed may be formed depending on the number of sheets P2 to be erase-processed.

After performing the decoloring process and the refresh process 2 from Act 71 to Act 77, the operation of the image forming apparatus 1 proceeds to Act 8. In Act 8, the control unit 22 corrects the predetermined performance value of the number of accumulated printed sheets according to the number of formed solid images. For example, the control unit 22 increases the predetermined, performance value, for example, by from 500 to 700 according to the number of formed solid images. In other words, the control unit 22 increases the predetermined performance value by from 500 to 700 according to the number of solid images formed in the refresh process 2, thereby extending the period of the next refresh process 1.

When the erasing process is performed, the image forming apparatus 1 rotates the transfer belt 15 to transport the sheet P2 to the heating unit 21 although the image forming process is not performed. As described above, the transfer belt 15 comes in contact with the cleaning blade 17. Accordingly, when the toner refresh process is not performed and the erasing process is frequently performed, the period of rotating the transfer belt 15 in a state where the toner is not transferred from the photoreceptor drum 12 lengthens, and thus the cleaning blade 17 easily deteriorates by friction against the transfer belt 15.

When the erasing process is performed, the image forming apparatus 1 according to the first embodiment forms a solid image on the transfer belt 15 for the refresh process 2. Accordingly, the transfer belt 15 is in a state where a toner film is coated by the solid image. The toner film serves as a lubricant, and it is suppressed that the cleaning blade 17 deteriorates by friction against the transfer belt 15. In addition, since the image forming apparatus 1 according to the first embodiment performs the refresh process 2 with the erasing process, it is possible to extend the period of the refresh process 1 performed according to the number of accumulated printed sheets, and thus it is possible to shorten the period of performing only the refresh process 1 overall.

When the refresh process 2 is performed with the decoloring process, in Act. 8, the predetermined performance value of the number of accumulated printed sheets is increased, for example, by from 500 to 700, to extend the period of the next toner refresh process 1, but the embodiment is not limited to the extending method. For example, when the refresh process 2 is performed at least once before the period of the next toner refresh process 1, the count value of the number of accumulated printed sheets is initialized to 0, and the next refresh process 1 may not be performed. In addition, in the period to the next toner refresh process 1, when the refresh process 2 is performed, the number of solid images formed in the refresh process 1 may be decreased according to the number of solid images formed in the refresh process 2.

The refresh process 2 with the decoloring process may be performed at a timing overlapped with the decoloring process. The electric field forming unit that forms the transfer electric field is not limited to the transfer roller, may be a member coming in contact with the transfer belt 15 with conductivity, and may be, for example, a conductive rubber blade, a conductive brush, and a conductive sheet.

When the image forming process is performed, the positive transfer bias voltage is applied to the secondary transfer roller 20 to transfer the image formed by the erasable toner of the transfer belt 15 onto the sheet P1, but the toner image of the transfer belt 15 may be transferred onto the sheet P1 by applying the negative transfer bias voltage to the secondary transfer opposed roller 19. When the negative transfer bias voltage is applied to the secondary transfer opposed roller 19, the secondary transfer opposed roller 19 is the electric field forming unit.

In the image forming apparatus 1, the heating unit 21 serves as both of the fixing unit and the erasing unit, but the erasing unit and the fixing unit are configured as separate units. In addition, in the image forming apparatus 1, the two-component developer formed of the erasable toner and the carrier is used, but one-component developer formed of only the erasable toner may be used.

In the first embodiment, the erasing unit has a configuration of heating the toner image of the sheet to erase the toner image using the toner decolored by heat as the erasable toner. However, the erasing unit may have a configuration of degrading the toner image by irradiating the sheet with light such as near-infrared light using a photodegradable toner degraded by irradiation of light such as near-infrared light, as the erasable toner. In addition, the erasing unit may have a configuration of immersing the sheet in a treatment liquid to peel off the toner image from the sheet using a toner peeled off from the sheet by immersion in the treatment liquid, as the erasable toner.

An image forming apparatus according to a second embodiment will be described with reference to FIG. 5. FIG. 5 is a cross-sectional view illustrating main units of an image forming apparatus 100 according to the second embodiment. The image forming apparatus 100 according to the second embodiment can form a color image, and can form an image using an erasable toner and a non-erasable toner. As illustrated in FIG. 5, the image forming apparatus 100 includes photoreceptor drums 120Y to 120K and development units 130Y to 130K. The photoreceptor drums 120Y to 120K and the development units 130Y to 130K are photoreceptor drums and development units for the non-erasable toner, respectively. The image forming apparatus 100 includes photoreceptor drums 12Y to 12K and development units 13Y to 13K. The photoreceptor drums 12Y to 12K and the development units 13Y to 13K are photoreceptor drums and development units for the erasable toner, respectively. The photoreceptor drums 12Y to 12K and the development units 13Y to 13K are provided along the transfer belt 15. The photoreceptor drums 120Y to 120K and the development units 130Y to 130K are provided along the transfer belt 15 and at a position further to the secondary transfer position U side than the photoreceptor drums 12Y to 12K and the development units 13Y to 13K. Although not illustrated in FIG. 5, as described in the first embodiment, the image forming apparatus 100 further includes a laser unit 11, a primary transfer roller 16, and a cleaning blade 14 for each of the photoreceptor drums 12Y to 12K and 120Y to 120K. The positions of the photoreceptor drums 120Y to 120K and the development units 130Y to 130K may be reverse to the positions of the photoreceptor drums 12Y to 12K and the development units 13Y to 13K.

Each of the development units 13Y to 13K and 130Y to 130K accommodates corresponding toner of yellow (Y), magenta (M), cyan (C), or black (K) different in color. As described in the first embodiment, the image forming apparatus 100 performs the image forming process, the toner refresh process, and the erasing process illustrated in FIG. 2 to FIG. 4. When the erasing process is performed, a solid image formed by the non-erasable toner may be formed on the transfer belt 15 by the photoreceptor drums 120Y to 120K and the development units 130Y to 130K, and may perform the refresh process 2 of the development units 130Y to 130K. In addition, when the erasing process is performed, both of a solid image formed by the erasable toner and a solid image formed by the non-erasable toner may be formed, and the refresh process 2 of the development units 13Y to 13K and 130Y to 130K may be performed. A proper number of development units may be provided in the image forming apparatus 100 according to kinds of colors to be used. For example, when one black color is to be used, the image forming apparatus 100 may be provided with only combination of the development unit 13K accommodating the black erasable toner and the development unit 130K accommodating the black non-erasable toner.

In the embodiment, the transfer belt may not be provided, and a configuration in which the toner image is directly transferred from the photoreceptor drum onto the sheet may be used. In the case of the direct transferring, for example, the photoreceptor drum is the image bearing body, the primary transfer roller 16 is the transfer unit that directly transfers the toner image from the photoreceptor drum onto the sheet, and the cleaning blade 14 is the cleaning blade that removes the toner image of the image bearing body. The process sequence in each of the embodiments may be different from the sequence exemplified in the embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fail within the scope and spirit of the inventions.

What is claimed is:

1. An image forming apparatus which forms an image on a recording medium, comprising:

an image forming unit configured to perform an image forming process of forming an image on an image bearing body by a toner and transferring the toner image from the image bearing body onto the recording medium, and a refresh process of forming an image on the image bearing body by the toner and removing the toner image from the image bearing body;

an erasing unit configured to erase the image formed on the recording medium using an erasable toner; and a control unit configured to control the image forming unit such that the image forming unit performs the refresh process together with the erasing process performed by the erasing unit.

2. The image forming apparatus according to claim 1, wherein the image forming unit includes a transfer unit that transfers the toner image formed on the image bearing body to the recording medium when the image forming process is performed.

3. The image forming apparatus according to claim 2, wherein the control unit controls the transfer unit to suppress that the toner image formed on the image bearing body is transferred onto the recording medium when the refresh process is performed.

4. The image forming apparatus according to claim 3, wherein the transfer unit includes a transfer roller which is provided in contact with the image bearing body, and to which a bias voltage is applied.

5. The image forming apparatus according to claim 4, wherein the control unit controls the bias voltage to transfer the toner image formed on the image bearing body onto the recording medium when the image forming process is performed, and not to transfer the toner image formed on the image bearing body onto the recording medium when the refresh process is performed.

6. The image forming apparatus according to claim 5, wherein the control unit controls the bias voltage to apply a bias voltage with a reverse polarity to the case of performing the image forming process to the transfer roller when the refresh process is performed.

7. The image forming apparatus according to claim 5, wherein the erasing unit includes a heating unit that serves as a fixing unit fixing the toner image transferred onto the recording medium when the image forming process is performed, and the image bearing body includes a transfer belt that transports the recording medium to the heating unit with the recording medium interposed between the transfer roller and the image bearing body.

8. The image forming apparatus according to claim wherein the control unit controls the image forming unit to periodically perform the refresh process separately from the refresh process performed with the erasing process.

9. The image forming apparatus according to claim 8, wherein the control unit controls the image forming unit to perform the refresh process separately from the refresh process performed with the erasing process when the number of image formation times formed by the image forming process reaches a predetermined performance value.

10. The image forming apparatus according to claim 9, wherein the control unit corrects the predetermined performance value when the refresh process is performed with the erasing process.

* * * * *